US006205795B1

(12) United States Patent
Backman et al.

(10) Patent No.: US 6,205,795 B1
(45) Date of Patent: Mar. 27, 2001

(54) SERIES SECONDARY COOLING SYSTEM

(76) Inventors: Thomas J. Backman, 105 Core Dr., Morehead City, NC (US) 28557; James Roomburg, 755 Rochelle Arch, Virginia Beach, VA (US) 23464

( * ) Notice: Subject to any disclaimer, the term of this patent is extended or adjusted under 35 U.S.C. 154(b) by 0 days.

(21) Appl. No.: 09/316,836

(22) Filed: May 21, 1999

(51) Int. Cl.[7] ..... F25B 7/00
(52) U.S. Cl. ..... 62/79; 62/434
(58) Field of Search ..... 62/434, 79

(56) References Cited

U.S. PATENT DOCUMENTS

| | | | | |
|---|---|---|---|---|
| 1,782,651 | | 11/1930 | Hoffman . | |
| 2,796,743 | * | 6/1957 | McFarlan | 62/434 |
| 3,247,678 | * | 4/1966 | Mohlman | 62/434 |
| 4,135,369 | | 1/1979 | Allgeyer et al. | 62/251 |
| 5,042,262 | | 8/1991 | Gyger et al. | 62/64 |
| 5,138,845 | | 8/1992 | Mannion et al. | 62/99 |
| 5,318,106 | | 6/1994 | Dorini et al. | 165/40 |
| 5,524,442 | | 6/1996 | Bergman, Jr. | 62/86 |
| 5,713,211 | | 2/1998 | Sherwood | 62/114 |
| 5,819,549 | | 10/1998 | Sherwood | 62/246 |

* cited by examiner

*Primary Examiner*—Ronald Capossela
(74) *Attorney, Agent, or Firm*—Mills Law Firm PLLC

(57) ABSTRACT

A secondary loop refrigeration system includes plural refrigeration zones serially connected in a secondary cooling loop using a liquid refrigerant in increasing order of operating temperatures, the secondary cooling loop being in heat exchange relationship with a primary cooling loop using direct expansion refrigerants. The primary cooling loop may be selectively isolated allowing the latent heat of the units in the zones to increase the circulating temperature of the secondary refrigerant sufficient to defrost the cooling coils.

13 Claims, 1 Drawing Sheet

SERIES SECONDARY COOLING SYSTEM

FIELD OF THE INVENTION

The present invention relates to secondary loop refrigeration, and in particular, to a method and apparatus using secondary loop cooling for controlling temperature in a series circuit of refrigeration devices having differing operating temperature requirements.

BACKGROUND OF THE INVENTION

The cooling system for commercial and retail establishments generally comprise a remotely located primary unit that is individually connected to the various cooling loads or zones therein, such as air conditioning, low temperature freezer units, and mid-temperature refrigeration units. Such arrangements in a typical supermarket refrigeration system oftentimes require hundreds or thousands of pounds of refrigerant charge in addition to thousands of feet of refrigerant lines. Additionally, plural primary units may be employed, however, each conditioned area nonetheless requires individual connection.

The problems associated with the above approaches have been further complicated by changes in the permissibility and availability of direct expansion refrigerants commonly used for such systems. Certain chlorofluorocarbons and perfluoroalkanes are being phased out because of their environmental impact. To the extent obtainable, the cost of such refrigerants are increasing markedly making the cost of the installed system considerably more expensive. Certain non-chlorinated low temperature and medium temperature refrigerants have been developed as alternatives, however, they tend to be even more costly. Other high temperature direct expansion refrigerants, such as R-134a, are more moderate in cost, but are not effective in direct expansion cooling systems below air conditioning. temperatures.

The foregoing problems have prompted refrigeration equipment manufacturers to propose the use of secondary liquid cooling. Therein, a primary condensing unit is closely coupled to a direct expansion heat exchanger. The refrigerant for the primary system may be selected based on performance, and because of the shorter supply lines the cost thereof is reduced. The direct expansion heat exchanger is coupled to a secondary system using a liquid secondary refrigerant. The secondary refrigerant is pumped through individual secondary lines to the liquid chilling coils in. various temperature control zones, such a refrigerated displays, walk-in coolers and the like.

One such system is disclosed in U.S. Pat. No. 5,713,211 to Sherwood. Therein, a liquid secondary refrigerant is directed in a secondary cooling loop from a primary-secondary heat exchanger to a series of display cases and pumped back to the heat (exchanger. Only a single zone, of the many zones typically found in commercial applications, is covered in the secondary loop. The secondary loop is not operative to provide coil defrosting.

Another approach is disclosed in U.S. Pat. No. 5,524,442 to Bergman et. al. wherein a secondary refrigeration loop employs an open loop air stream that directly impinges a product to be cooled. The secondary loop return air system is directed to a secondary heat exchanger interfaced with a primary refrigeration loop.

A plurality of secondary refrigeration loops using a single refrigerant are disclosed in U.S. Pat. No. 5,318,845 to Dorini et. al. and U.S. Pat. No. 5,138,845 to Mannion et. al. Therein, the return lines of the primary refrigeration are fed in parallel as the inlet lines to the secondary cooling loads and the secondary return lines are connected with the primary inlet lines. Control systems are provided with each cooling load to control temperature and flow rates. While providing some localization of lines, a single refrigerant charge for the cooling demands of the generally similar temperature demands of the various units of the system.

A further approach is disclosed in U.S. Pat. No. 5,042,262 to Gyger et. al. wherein second closed loop system is operative to transfer heat from a single heat sink using carbon dioxide as a secondary refrigerant.

It is apparent from the above that such secondary loop designs have not focused on the major problems associated with plural refrigerant systems, i.e. consolidation of the high cost/high performance primary refrigerant loop and a secondary loop capable of handling plural cooling zones of the type found in supermarkets, cold storage facilities, hospitals, industrial plants, hotels, shopping centers, and like locations requiring cooling, refrigeration and heating. By focusing on parallel exchanges, high fluid volume cost, high equipment costs, and power consumption for fluid transfer remain a problem.

SUMMARY OF INVENTION

The present invention addresses and overcomes the aforementioned problems and limitations by providing a secondary refrigeration system incorporating a continuous series of progressively increasing temperature zones in a single secondary cooling loop. Therein, a secondary fluid is interfaced with the primary system and has the fluid feed line connected in parallel to a plurality of cooling loads having the highest cooling demands, such as freezer units. The return lines of the first loads are combined and fed to a second zone of cooling loads having the next highest cooling demand, such as refrigerated displays. Thereafter the second zone return lines are fed back to the heat exchanger or to subsequent zones in a similar manner, such as air conditioning equipment.

Such design eliminates the need for individual piping for each zone thereby reducing refrigerant, equipment, power consumption and piping costs. Moreover, the heat exchanger may be bypassed for defrosting the coils in the zones wherein the temperature rise from the line loading will warm the coils sufficiently for defrosting, while upon completion of defrosting, the system may be quickly returned to operative status. Furthermore, the aforementioned design permits the use of low cost non-chlorinated fluids operative in the liquid phase providing the requisite viscosity, specific heat, thermal conductivity, and environmental acceptability while providing efficient heat transfer within temperatures ranging from −40° F. to +80° F.

Accordingly, it is an object of the present invention to provide a secondary cooling system having reduced material, equipment and operating costs in conditioning a plurality of cooling zones.

A further object of the invention is to provide a plurality of increasing temperature zones that are serially connected in a secondary cooling loop.

Another object of the invention is to provide secondary cooling loop system using environmentally acceptable high performance refrigerants in a liquid phase with chilling coils in a series connection of increasing temperature zones.

Yet another object of the invention is to provide a liquid secondary refrigeration loop connecting a plurality of cooling zones wherein the loop may be quickly and conveniently disabled allowing the latent heat from the units to raise the temperature of the fluid sufficiently for defrosting purposes.

DESCRIPTION OF DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
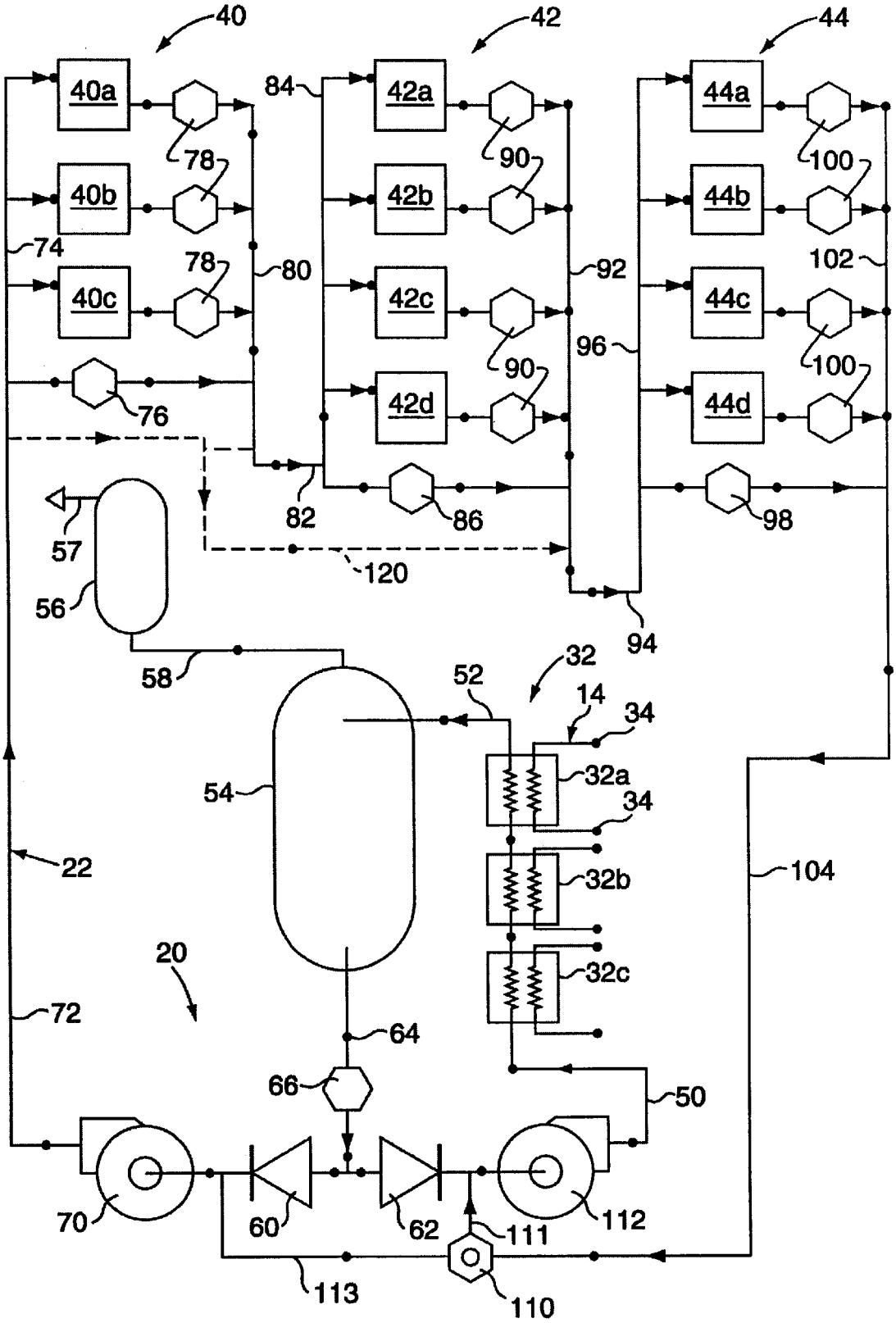
FIG. 1 is a schematic diagram of a serial banked secondary refrigeration system in accordance with the present invention.

Referring to the drawings for the purpose of describing a preferred embodiment of the present invention and not for limiting same, FIG. 1 shows a refrigeration system 10 for a facility having a plurality of cooling zones or loads to be maintained respectively at differing temperatures.

The system 10 includes a primary refrigeration system 12 for transferring heat in a primary loop 14 to an external environment using a primary refrigerant, and a secondary loop refrigeration system 20 for transferring heat from the cooling zones in a secondary loop 22 to the primary refrigeration system 12 using a secondary refrigerant. The system 10 is suitable for installation in a supermarket setting and will be described with reference thereto. However, it will become apparent that the system may be beneficially utilized in other multiple zone venues including without limitation cold storage facilities, hospitals, refrigerated industrial plants, hotels, shopping centers, laboratories, prisons, schools and industrial, institutional, commercial and residential spaces requiring temperature control at varying levels in multiple zones.

The primary refrigeration system 12 may be any suitable commercially available design comprising typically a remotely located compressor unit (not shown), located (external of the facility and typically on the roof thereof, having inlet lines 30 communicating with a multiple stage direct-expansion evaporator 32 having; stages 32*a*, 32*b* and 32*c*; and a return line 34 returning to the compressor unit. A suitable primary refrigerant for the primary loop would be R-22, R-404A or R-507. The evaporator 32 is preferably located proximate the compressor unit in order to minimize the length of the primary loop 12 and the primary refrigerant charge, but with convenient access to the cooling zones, to be controlled.

As described below in greater detail, the secondary refrigeration system 20 is connected with cooling zones or loads including a low temperature units 40, such as freezers maintained in the operating range of about −40° F. to +9° F., medium temperature units 42 maintained in the operating range of about +10° F. to +38° F., and air conditioned units 44 maintained in the operating range of about +39° F. to +80° F. Plural units are illustrated for each zone, however, it will be appreciated that the number of units and zones will vary depending on the requirements of a particular facility.

The secondary refrigeration system includes an inlet line 50 leading to the evaporator 32, an exit line 52 leading from the evaporator 32 to a coolant reservoir 54. An expansion tank 56 having a pressure relief valve 57 is connected to the reservoir 54 by line 58. The reservoir 54 is connected with branched check valve 60, 62 through exit line 64 that includes a pressure regulator 66. Refrigerated fluid from the reservoir 54 flows past check valve 60 to a supply pump 70. The supply pump 70 is effective for maintaining flow and pressure conditions through the temperature zones and may be either a constant volume or constant pressure pump depending on the overall needs of the cooling system. At various locations as illustrated by the unnumbered solid circles, isolation valve may be provided for temporarily isolating discrete sections of the system.

The secondary refrigerant flows from the pump 70 through line 72 to a low temperature inlet manifold 74 having parallel inlet lines respectively communicating with freezer units 40*a*, 40*b*, 40*c*, and bypass valve 76. The outlet lines of the freezer units include temperature control valves 78 communicating in parallel with the exit line of valve 76 with a low temperature exhaust manifold 80. In a conventional manner, the valves 78 are individually effective to maintain desired temperature conditions in the units 40 in a well known manner. The bypass valve 76 may be stepped or continuous varied by appropriate controls to maintain volumetric flow conditions in the secondary loop 22 sufficient for the overall needs of the system 10. Additionally, the intake manifold 74 and the units 40 may include isolation valves, as illustrated, for removing the units from operation for service, replacement and the like.

The exhaust manifold 80 of the low temperature units 40 is connected by intermediate line 82 with a mid-temperature intake manifold 84 having inlets communicating with the mid-temperature units 42*a*, 42*b*, 42*c*, 42*d* and bypass valve 86. The outlet lines of the refrigerator units include temperature control valves 90 communicating in parallel with the exit line of valve 86 with a mid-temperature exhaust manifold 92. In a conventional manner, the valves 90 are individually effective to maintain desired temperature conditions in the refrigeration units 42 in a well-known manner. The bypass valve 86 may be stepped or continuous varied by appropriate controls to maintain volumetric flow conditions in the secondary loop 22 sufficient for the overall needs of the system 10. Additionally, units 42 may include isolation valves for removing the units from operation for service, replacement and the like.

The exhaust manifold 92 of the mid-temperature units 42 is connected by intermediate line 94 with a high-temperature intake manifold 96 having inlets communicating with the air conditioning units 44*a*, 44*b*, 44*c*, 44*d* and bypass valve 98. The outlet lines of the air conditioning units include temperature control valves 100 communicating in parallel with the exit line of valve 98 with an air conditioning exhaust manifold 102. In a conventional manner, the valves 100 are individually effective to maintain desired temperature conditions in the air conditioning units. The bypass valve 96 may be stepped or continuous varied by appropriate controls to maintain volumetric flow conditions in the secondary loop 22 sufficient for the overall needs of the system 10. Additionally, units 44 may include isolation valves for removing the units from operation for service, replacement and the like.

The exhaust manifold 102 is connected by line 104 to the inlet of a three-way defrost valve 110. One outlet line from the valve 110 is fluidly connected between check valve 60 and supply pump 70. The other outlet line from defrost valve 110 is fluidly (connected between check valve 62 and circulation pump 112 that has an outlet connected with the inlet line 50 to the heat exchanger 32. A further isolation circuit 120, illustrated by the dashed lines, may be included.

It will thus be appreciated that the three sets of cooling loads are serially connected in the secondary loop 22, with parallel flow across the individual units in each stage. Such arrangement avoids the need for individual fluid connections with each stage, thereby reducing equipment, installation and refrigerant costs. Further, by operating the secondary loop in the liquid phase, numerous non-chlorinated, lower cost refrigerants may be employed. In particular, R-134a, while compatible with direct expansion systems is surprisingly effective in the fluid stages of the present invention providing an operational range from about −40° F. to +80° F. Other refrigeration fluids suitable for the secondary system include: glycol solutions, propylene glycol, ethylene glycol, brines, inorganic salt solutions, potassium solutions, potassium formiate, silicone plymers, synthetic organic fluids, eutectic solutions, organic salt solutions, citrus terpenes, hydrofluouroethers, hydrocarbons, chlorine compounds, methanes, ethanes, butane, propanes, pentanes, alcohols, diphenyl oxide, biphenyl oxide, aryl ethers, terphenyls, azeotropic blends, diphenylethane, alkylated aromatics, methyl formate, polydimethylsiloxane, cyclic organic compounds, zerotropic blends, methyl amine, ethyl amine, ammonia, carbon dioxide, hydrogen, helium, water, neon, nitrogen, oxygen, argon, nitrous oxide, sulfur dioxide, vinyl chloride, propylene, R400, R401A, R402B, R401C, R402A, R402B, R403A, R403B, R404A, R405A, R406A, R407A, R407B, R407C, R407D, R408A, R409A, R409B, R410A, R410B, R411A, R411B, R412A, R500, R502, R503, R504, R505, R506, R507A, R508A, R508B, R509A, R600A, R1150, R111, R113, R114, R12, RR22, R13, R116, R124, R124A, R125, R143A, R152A, R170, R610, R611, sulfur compounds, R12B1, R12B2, R13B1, R14, R22B1, R23, R32, R41, R114, R1132A, R1141, R1150, R1270, fluorocarbons, carbon dioxide, solutions of water, and combinations of the above fluids.

Operation of the Secondary Fluid Cooling System

With the primary system operating, the pumps 70 and 112 are started to circulate the secondary refrigerant in the secondary loop 22. The capacity of the secondary loop 22 will be dependent on the cooling loads for the individual stages and the capacity of the evaporator 32. Generally the entry. temperatures for the secondary refrigerant are −40 F to 0 F for the freezer stage, +1 F to +30 F for the refrigeration stage, and +34 F to +50 F for the air conditioning stage. Passing through the first stage, the secondary refrigerant will experience a temperature rise based on the demand thereat, however, the entrance temperature and flow at the second stage for handling the refrigeration requirements in the refrigeration units. Similarly, the conditions presented to the air conditioning units will be sufficient to handle the load requirements for this stage.

Operation of the Defrost Cycle

From time to time, the cooling, coils at the units may experience a frost or ice buildup limiting the cooling performance of the units. The secondary cooling system of the present invention may be quickly reconfigured to initiate a defrost cycle therefor. Such a cycle may be initiated by switching the position of the defrost valve 110 to the defrost position routing the fluid from line 104 to line 113. This results in plural flow paths. First, circulation of the fluid will be maintained between the reservoir 54 and the evaporator 32 by pump 112 thereby maintaining a supply of cooled refrigerant for immediate use after the defrost cycle. Second, a loop will be established bypassing the evaporator 32 and reservoir such that the temperature rise in the secondary refrigerant experienced at the air conditioning stage will circulate through the freezer and refrigerator coils thereby defrosting and deicing the associated units. Upon completion of the defrost cycle, the valve 110 is reversed and refrigerated fluid is immediately circulated in the secondary loop for quickly restoring refrigerated operating conditions.

The above description is intended to be illustrative of the preferred embodiment, and modifications and improvements thereto will become apparent to those in the art. Accordingly, the scope of the invention should be construed solely in accordance with the appended claims.

What is claimed is:

1. A refrigeration system, comprising: a primary refrigeration system operating in a primary loop and carrying a primary refrigerant; a secondary refrigeration system operating in a secondary loop and carrying a secondary liquid refrigerant; heat transfer means for transferring heat from said secondary loop to said primary loop; a plurality of cooling zones having differing temperatures to be maintained therein in serial heat transfer relationship with said secondary loop, said cooling zones being connected to said secondary loop in order of increasing temperatures.

2. The refrigeration system as recited in claim 1 wherein said secondary refrigerant is a liquid.

3. The refrigeration system as recited in claim 2 wherein said liquid is R-134a.

4. The refrigeration system as recited in claim 2 wherein said secondary loop includes an in-line coolant reservoir downstream of said heat transfer means for maintaining a storage supply.

5. The refrigeration system as recited in claim 4 including a bypass line interposed in said secondary loop for bypassing said heat exchange means and said reservoir, and valve means for selectively opening and closing said bypass line.

6. The refrigeration system as recited in claim 2 wherein each of said cooling zones comprises discrete cooling loads having inlets communicating in parallel with said secondary loop upstream of the associated zone and outlets communicating in parallel with said secondary loop downstream of said associated zone.

7. The refrigeration system as recited in claim 6 wherein temperature control means are associated with said outlets for individually maintaining temperature conditions therein.

8. The refrigeration system as recited in claim 6 including a bypass line connected in said secondary loop in parallel with said cooling loads for controlling fluid flow conditions downstream of the units.

9. The refrigeration system as recited in claim 8 wherein said cooling zones include a second refrigeration stage connected in series with said first freezer stage and downstream thereof in said secondary loop.

10. The refrigeration system as recited in claim 9 wherein said cooling zones include a third air conditioning stage connected in series with said first freezer stage and said second refrigeration stage and downstream thereof in said secondary loop.

11. A method of transferring heat from two zones maintain at different temperatures, comprising the steps of: providing a first heat sink; providing a first heat source; transferring heat between said first heat source and said first heat sink using a first heat transfer medium; providing a second heat sink thermally connecting said zones in series in order of increasing temperature using a non-chlorinated liquid refrigerant as a second heat transfer medium; and transferring heat between said second heat transfer medium and said first heat transfer medium.

12. A method of transferring heat as recited in claim 11 including the step of interrupting said transferring heat between said second heat transfer medium and said first heat transfer medium while maintaining said thermally connecting of said zones thereby providing a defrosting cycle for said zones.

13. The method of transferring heat as recited in claim 11 including providing at least two discrete units in each zone having inlets and outlets thermally connected in parallel with said second heat transfer medium.

* * * * *